US010912695B2

(12) United States Patent
Revenus et al.

(10) Patent No.: US 10,912,695 B2
(45) Date of Patent: Feb. 9, 2021

(54) OPERATING TABLE

(71) Applicant: MAQUET GMBH, Rastatt (DE)

(72) Inventors: Rolf Revenus, Kuppenheim (DE); Peter Harlacher, Buhl (DE)

(73) Assignee: MAQUET GMBH, Rastatt (DE)

( * ) Notice: Subject to any disclaimer, the term of this patent is extended or adjusted under 35 U.S.C. 154(b) by 452 days.

(21) Appl. No.: 15/838,276

(22) Filed: Dec. 11, 2017

(65) Prior Publication Data

US 2018/0104124 A1 Apr. 19, 2018

Related U.S. Application Data

(63) Continuation-in-part of application No. PCT/EP2016/063118, filed on Jun. 9, 2016.

(51) Int. Cl.

| | |
|---|---|
| ***A61G 13/04*** | (2006.01) |
| ***A61G 13/08*** | (2006.01) |
| ***A61G 13/10*** | (2006.01) |

(52) U.S. Cl.

CPC ..... *A61G 13/04* (2013.01); *A61G 13/08* (2013.01); *A61G 13/107* (2013.01); *A61G 2203/12* (2013.01)

(58) Field of Classification Search

CPC ..... A61G 13/04; A61G 13/08; A61G 13/107; A61G 2203/12

See application file for complete search history.

(56) References Cited

U.S. PATENT DOCUMENTS 3,041,121 A * 6/1962 Comper ..... A61G 13/00 5/618
3,206,188 A * 9/1965 Douglass, Jr. ..... A61G 13/02 5/614
3,281,141 A * 10/1966 Smiley ..... A61G 13/00 5/614

(Continued)

FOREIGN PATENT DOCUMENTS

CN 101357096 A 2/2009
EP 0132179 A1 1/1985

(Continued)

OTHER PUBLICATIONS

English translation of International Search Report issued for corresponding PCT Application No. PCT/EP2016/063118, dated Sep. 2, 2016, 3 pages.

(Continued)

*Primary Examiner* — Robert G Santos
*Assistant Examiner* — Rahib T Zaman

(57) ABSTRACT

The present disclosure describes an operating table with an operating table column and a patient bearing surface arranged on the operating table column, wherein the operating table column comprises a column cladding with at least two rigid components arranged one above the other. The operating table column is designed and configured so that all movable parts of the operating table running inside the operating table column are completely covered laterally. An intermediate space extends from the upper edge of the two components of the column cladding arranged one above the other as far as the patient bearing surface, the intermediate space being a bellows-free space.

23 Claims, 8 Drawing Sheets

(56) References Cited

U.S. PATENT DOCUMENTS 3,411,766 A * 11/1968 Lanigan ..... A61G 13/105 5/619
3,452,977 A * 7/1969 Ryman ..... A61B 6/04 5/601
3,754,749 A * 8/1973 Lyon ..... A61G 13/009 5/618
3,851,870 A * 12/1974 Cook ..... A61G 13/08 5/618
3,868,103 A * 2/1975 Pageot ..... A61G 13/02 5/614
4,148,472 A * 4/1979 Rais ..... A61G 13/02 5/601
4,186,917 A * 2/1980 Rais ..... A61G 13/02 5/614
4,195,829 A 4/1980 Reser
4,501,414 A * 2/1985 Mason ..... A61G 13/02 378/209
4,761,000 A * 8/1988 Fisher ..... A61G 13/02 5/600
4,865,303 A * 9/1989 Hall ..... A61G 13/04 5/614
4,872,657 A * 10/1989 Lussi ..... A61G 13/02 5/608
4,958,817 A * 9/1990 Heller ..... A61G 13/04 5/607
5,231,719 A * 8/1993 Schnelle ..... A61G 13/08 5/614
6,038,718 A * 3/2000 Pennington ..... A61B 6/04 5/608
6,672,668 B1 * 1/2004 Boruta ..... A61G 15/02 297/354.12
6,721,976 B2 * 4/2004 Schwaegerle ..... A61G 13/04 5/507.1
6,754,923 B2 * 6/2004 Borders ..... A61G 12/00 5/618
6,886,200 B2 * 5/2005 Blyshak ..... A61G 13/02 254/93 R
6,944,897 B2 * 9/2005 Koch ..... A61G 13/101 248/316.1
7,073,222 B1 * 7/2006 Skripps ..... A61G 13/04 5/607
7,073,464 B2 * 7/2006 Keil ..... A61D 3/00 108/24
7,125,167 B2 * 10/2006 Alakkat ..... A61B 6/04 378/209
7,669,260 B2 * 3/2010 Smith ..... A61G 13/0018 5/604
7,694,366 B2 * 4/2010 Koch ..... A61G 13/04 5/608
7,810,185 B2 * 10/2010 Burstner ..... A61G 13/02 5/600
7,818,839 B2 * 10/2010 Koch ..... A61G 13/02 5/613
9,480,615 B2 * 11/2016 Eisenmann ..... A61G 13/104
2005/0066861 A1 * 3/2005 DeBraal ..... A47B 9/00 108/147
2009/0126112 A1 * 5/2009 Kuchenbecker ..... A61G 12/007 5/600
2017/0326014 A1 * 11/2017 Staudinger ..... A61G 13/1245

FOREIGN PATENT DOCUMENTS

GB 728093 A 4/1955
JP 2005-504605 2/2005
JP S31-9691 U 12/2016
WO 2013/069952 A1 5/2013
WO 2014/195396 A1 12/2014
WO 2014195126 A1 12/2014

OTHER PUBLICATIONS

STERIS® 4085 General Surgical Table: Advancing Care Through Practical Innovation, Informational Brochure, May 2016, 8 pages.
Operator Manuel for Cmax™ Surgical Table, dated Mar. 16, 2009, 60 pages, accessed via Internet 2018, Steris Corporation, manual.
Steris 4085 General Surgical Table, General Information, dated 2009, 8 pages, accessed via internet 2018, Steris Corporation, Steris Corporation, brochure.
NHS Purchasing and Supply Agency, Buyers' guide: Operating tables, CEP09016, dated Aug. 2009, 93 pages, accessed via Internet 2018, NHS.
Berchtold Components and Accessories for OPERON® OR Tables, dated Nov. 2013, 124 pages, accessed via Internet 2018, Berchtold GmbH & Co. KG., user manual.
Berchtold OPERON® B 810 Installation & Operating Manual, dated 2005, 43 pages, accessed via Internet 2018, Berchtold Corporation, manual.
Schaerer Axis 400/500/600/700/800—Mobile Operating Tables for All Surgical Applications, Technical Data Sheet, dated 2010, 13 pages, accessed via Internet 2018, Schaerer Medical AG.
Berchtold and Stryker OPERON® D Series Surgical Tables, Manual, dated 2014, 20 pages, accessed via Internet 2018, Berchtold GmbH & Co. KG.
Berchtold OPERON® B 710 User Manual, dated 2004, 53 pages, accessed via Internet in 2018, Berchtold GmbH & Co. KG., user manual.
Chinese Office Action and Chinese Search Report dated Sep. 19, 2019 during the prosecution of corresponding Chinese Patent Application No. 201680043291.X, 15 pages.
Notification of Reasons for Refusal dated Jul. 21, 2020 in corresponding JP Application No. 2017-564384.
Office Action issued in corresponding JP Application No. 2017-564384 dated Dec. 8, 2020, 2 pages.

* cited by examiner

OPERATING TABLE

CROSS REFERENCE TO RELATED APPLICATIONS

The present application is a continuation-in-part filed under 35 U.S.C. § 111(a), and claims the benefit under 35 U.S.C. § 365(c) of PCT International Application No. PCT/EP2016/063118, filed Jun. 9, 2016, which designates the United States of America, and claims the benefit of German Patent Application No. 10 2015 109 078.3, filed Jun. 9, 2015. The disclosure of each of these applications is incorporated by reference herein in its entirety.

TECHNICAL FIELD

The present disclosure relates to embodiments of an operating table with an operating table column and a patient bearing surface arranged on and supported by the operating table column.

BACKGROUND

There are known in the prior art operating tables with an operating table column and a patient bearing surface arranged on the operating table column. In these known operating tables, the operating table column is furnished with a column cladding.

FIG. 5 shows a perspective view of an operating table 100 according to the prior art. As shown in FIG. 5, the known operating table 100 comprises a patient bearing surface 102, which is arranged above an operating table column 104 provided with a column cladding. Moreover, FIG. 5 shows that the operating table column 104 is arranged on an operating table base 106. The patient bearing surface 102 comprises a first, second, third bearing surface section identified as reference numerals 110, 112, and 114 respectively. The operating table column 104 comprises four components 116*a* to 116*d* of the column cladding, arranged one above another. Between the upper component 116*d* of the four superposed components 116*a* to 116*d* and the patient bearing surface 102 there are provided a control component 118 and a bellows 120. The bellows 120 is integrated in the head piece of the operating table column 104. The operating table base 106 comprises several swivel rollers 108. The bellows 120 integrated in the head piece of the operating table column 104 serves for lateral covering of movable parts of the operating table 100 running inside the operating table column 104. In particular, these movable parts of the operating table 100 comprise energy-carrying conduits to supply energy to the patient bearing surface 102.

FIG. 6 shows a perspective view of an operating table 200 according to the prior art. As shown in FIG. 6, the known operating table 200 comprises a patient bearing surface 202, which is arranged above an operating table column 204 provided with a column cladding. Moreover, FIG. 6 shows that the operating table column 204 is arranged on an operating table base 206. The patient bearing surface 202 comprises a first and second bearing surface section 208, 212. The first bearing surface section 208 of the patient bearing surface 202 comprises a back plate 210, while the second bearing surface section 212 of the patient bearing surface 202 comprises a base plate 214. The operating table column 204 comprises four components 216*a* to 216*d* of the column cladding arranged one above the other. The upper component 216*d* of the four superposed components 216*a* to 216*d* comprises a control component 218. Moreover, between the upper component 216*d* of the four superposed components 216*a* to 216*d* and the patient bearing surface 202 there is provided a bellows 220. The bellows 220 is integrated in the head piece of the operating table column 204. The bellows 220 integrated in the head piece of the operating table column 204 serves for lateral covering of movable parts of the operating table 200 running inside the operating table column 204.

In particular, these movable parts of the operating table 200 comprise energy-carrying conduits to supply energy to the patient bearing surface 202.

Thus, a bellows 120, 220 is used in the operating tables 100, 200 of the prior art as shown in FIGS. 5 and 6. As shown by FIGS. 5 and 6, this bellows 120, 220 is provided in particular between the patient bearing surface 102, 202 and the upper component 116*d*, 216*d* of the column cladding.

The known operating tables have the drawback that their design is relatively complicated and costly on account of the use of a bellows provided between the patient bearing surface and the upper component of the column cladding.

Among certain disadvantages associated with the bellows, the cleaning of the folds of the bellows when the operating table is in operation is relatively difficult.

SUMMARY OF THE DISCLOSURE

Starting from the known prior art, a problem which embodiments of the present disclosure propose to solve is to provide an operating table which has a simple design and is easy to maintain during operation and use.

This problem and others are solved by an operating table with the features of embodiments of the present disclosure. Advantageous modifications are either indicated throughout the present disclosure or would otherwise be understood by one of skill in the art.

By an operating table with the features of the present disclosure, a simple design and a simple and convenient maintenance in operation and use are achieved, since in particular the operating table column has a column cladding with at least two rigid components arranged one above the other. In embodiments of the present disclosure, the operating table column is designed so that all (or at least a substantial portion of) of the movable parts of the operating table running inside the operating table column are completely covered laterally. Moreover, an intermediate space extends from the upper edge of the two components of the column cladding arranged one above the other as far as the patient bearing surface, the intermediate space being a bellows-free space. Thus, one may avoid the use of a bellows provided between the patient bearing surface and the upper component of the column cladding. Moreover, the relatively difficult cleaning of the folds of the bellows during use of the operating table is thus eliminated. This enables among other things the simple design and the simple maintenance of the operating table in use.

In various embodiments of the present disclosure, the operating table column is configured such that sections of the movable parts which extend from an upper edge of the superposed components of the column cladding to the patient bearing surface are not covered laterally by a bellows. In this way, the mentioned drawbacks of the prior art in connection with the known operating tables are avoided.

In various embodiments of the present disclosure, sections of the movable parts which extend from the upper edge of the two superposed components of the column cladding to the patient bearing surface are covered laterally, at least in part, by a first and second rigid headpiece element of the operating table column and/or a first and second rigid side rail of the patient bearing surface. Thus, these sections of the movable parts can be covered laterally only by rigid headpiece elements of the operating table column or rigid side rails of the patient bearing surface. Thus, instead of the bellows used in the prior art, non-folding components can be used for the lateral covering of these sections of the movable parts.

In various embodiments of the present disclosure, an upper component of the two superposed components of the column cladding is dome-shaped. Thus, a relatively large adjustment range of the patient bearing surface can be provided by tilting it about a tilt axis.

In various embodiments of the present disclosure, the upper component of the two superposed components of the column cladding comprises at least two side walls, which are inclined at least partly in the direction of the interior of the operating table column. Thus, the patient bearing surface when tilted about the tilt axis will not impact too fast against the upper component of the two superposed components of the column cladding.

In various embodiments of the present disclosure, the side walls of the upper component which are inclined in the direction of the interior of the operating table column are two side walls which are situated opposite each other. The two opposite side walls of the upper component may comprise a front side wall relative to a first direction parallel to the longitudinal direction of the patient bearing surface and a rear side wall relative to the first direction parallel to the longitudinal direction of the patient bearing surface. Thus, it is possible to provide a front and rear side wall relative to the first direction parallel to the longitudinal direction of the patient bearing surface which are each inclined in the direction of the interior of the operating table column. With the aid of these front and rear side walls, the relatively large adjustment range of the patient bearing surface can be achieved during a tilting movement of the same.

In various embodiments of the present disclosure, a lower component of the two superposed components of the column cladding comprises at least two side walls, which are inclined at least partly in the direction of the interior of the operating table column. Thus, the patient bearing surface when tilted edgewise about a lateral tilt axis will not impact too fast against the lower component of the two superposed components of the column cladding.

In various embodiments of the present disclosure, the side walls of the lower component which are inclined in the direction of the interior of the operating table column are two side walls which are situated opposite each other. The two opposite side walls of the lower component comprise a front side wall relative to a second direction parallel to the transverse direction of the patient bearing surface and a rear side wall relative to the second direction parallel to the transverse direction of the patient bearing surface. Thus, it is possible to provide a front and rear side wall relative to the second direction parallel to the transverse direction of the patient bearing surface which are each inclined in the direction of the interior of the operating table column. In this way, a relatively large adjustment range of the patient bearing surface can be achieved during a lateral tilting movement of the same about a lateral tilt axis.

In various embodiments of the present disclosure, the column cladding may be configured such that it can be separated into two halves along a separation line which runs substantially in the lifting direction of the patient bearing surface through the two superposed components of the column cladding. Thus, a simple separation of the two halves of the column cladding can be realized. In this way, the movable parts of the operating table running inside the operating table column can be easily maintained.

In various embodiments of the present disclosure, the column cladding comprises at least one half shell-shaped housing element integrated in a side wall of a lower component of the two superposed components of the column cladding in order to hold an IR (infrared) receiver. The half shell-shaped (or dome shaped) housing element is secured without screws to the side wall of the lower component. Thus, an easy fastening of the half shell-shaped housing elements to the side wall of the lower component or an easy separation of the same from the side wall of the lower component can be accomplished.

Preferably the column cladding has two halves which can be joined together, forming in the joined state the two superposed components of the column cladding. Thus, instead of a single column cladding part, one can provide two halves of the column cladding which can be joined together.

In various embodiments of the present disclosure, the column cladding has a tongue and groove arrangement for connecting the two halves of the column cladding. In this way, a simple and secure connection of the two halves of the column cladding can be accomplished.

In various embodiments of the present disclosure, the column cladding has an opening for leading through it a tilt cylinder coupled to the patient bearing surface. The opening is provided with a sealing element. Moreover, the sealing element is configured such that the opening is completely sealed in each position of the tilt cylinder. In this way, damaged components of the two superposed components of the column cladding can be replaced without dismantling the tilt cylinder.

In various embodiments of the present disclosure, the patient bearing surface can rotate about a tilt axis by a first angle of rotation greater than 20° in a positive and negative direction of rotation and/or about a lateral tilt axis by a second angle of rotation greater than 15° in the positive and negative direction of rotation. The first angle of rotation and the second angle of rotation are relative to a starting position of the patient bearing surface. In this way, a relatively good adjustment performance of the patient bearing surface can be achieved during a tilting movement or a lateral tilting movement of the same in regard to a starting position of the patient bearing surface.

In various embodiments of the present disclosure, the two superposed components of the column cladding are made of plastic. In this way, a suitable material can be used for the column cladding. Moreover, in this way the column cladding can be easily cleaned.

Further features and benefits of the embodiments of the present disclosure will emerge from the following description explaining aspects of the invention more closely with the aid of sample embodiments in connection with the enclosed figures.

DETAILED DESCRIPTION

For illustrative purposes, the principles of the present invention are described by referencing various exemplary embodiments. Although certain embodiments of the invention are specifically described herein, one of ordinary skill in the art will readily recognize that the same principles are equally applicable to, and can be employed in other systems and methods. Before explaining the disclosed embodiments of the present invention in detail, it is to be understood that the invention is not limited in its application to the details of any particular embodiment shown. Additionally, the terminology used herein is for the purpose of description and not of limitation. It must be noted that as used herein and in the appended claims, the singular forms "a", "an", and "the" include plural references unless the context clearly dictates otherwise. As well, the terms "a" (or "an"), "one or more" and "at least one" can be used interchangeably herein. It is also to be noted that the terms "comprising," "including," "composed of," and "having" can be used interchangeably.

Figure 1:
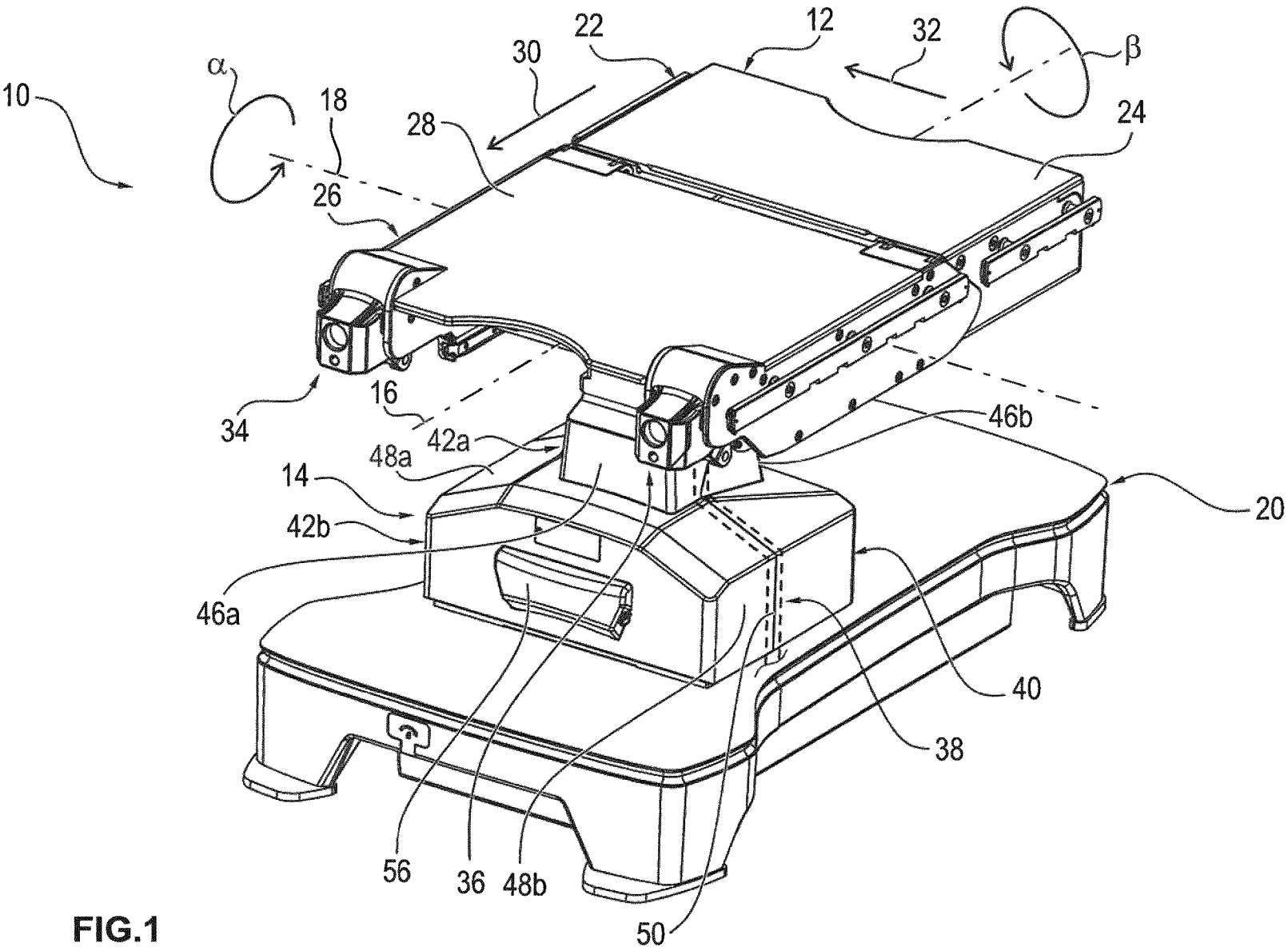
FIG. 1 is a perspective view of an operating table with an operating table column furnished with a column cladding according to one sample embodiment of the present disclosure.

FIG. 1 shows a perspective view of an operating table 10 with an operating table column 14 furnished with a column cladding 40 according to one sample embodiment of the present disclosure. As shown in FIG. 1, the operating table 10 comprises a patient bearing surface 12, which is arranged on the operating table column 14. Moreover, the operating table column 14 is arranged on the operating table base 20. The patient bearing surface 12 comprises a first and second bearing surface section 22, 26. The first bearing surface section 22 of the patient bearing surface 12 comprises a back plate 24, while the second bearing surface section 26 of the patient bearing surface 12 comprises a base plate 28.

Moreover, the patient bearing surface 12 comprises a first and second rigid side rail 34, 36.

Moreover, FIG. 1 shows that the patient bearing surface 12 is rotatable about a tilt axis 18 with a first angle of rotation α and/or about a lateral tilt axis 16 with a second angle of rotation β. The lateral tilt axis 16 runs parallel to a first direction 30, which is parallel to the longitudinal direction of the patient bearing surface 12, while the tilt axis 18 runs parallel to a second direction 32 which is parallel to the transverse direction of the patient bearing surface 12. Moreover, the lateral tilt axis 16 runs substantially through the center of the back plate 24 and the base plate 28, while the tilt axis 18 runs substantially through the center of the base plate 28.

Preferably, the first angle of rotation α is larger than 20°, while the second angle of rotation β is larger than 15°. The first angle of rotation α and the second angle of rotation β here are relative to the starting position of the patient bearing surface 12 as shown in FIG. 1 being substantially parallel to the ground surface S the operating table is resting on. Moreover, the first angle of rotation α and the second angle of rotation β each correspond to a rotation of the patient bearing surface 12 in a positive or negative direction of rotation. Thus, the adjustment performance of the patient bearing surface 12 shown in FIG. 1 may be relatively good and sufficient for desired usage conditions.

The operating table column 14 shown in FIG. 1 serves to cover entirely all the movable parts 38 of the operating table 10 running inside the operating table column 14 at the side. Preferably, these movable parts 38 of the operating table 10 constitute energy-carrying conduits to supply energy to the patient bearing surface 12, (such as motors or cylinders that may be part of the patient bearing surface). The energy-carrying conduits are shown schematically in FIG. 1 by broken lines. For example, the energy-carrying conduits constitute electrical and/or hydraulic lines.

In the sample embodiment shown in FIG. 1, the column cladding 40 comprises two rigid components 42*a*, 42*b* one on top of the other. Preferably, these two components 42*a*, 42*b* of the column cladding 40 are made of plastic. As shown in FIG. 1, the patient bearing surface 12 is arranged on the upper component 42*a* of the column cladding 40. Moreover, the upper component 42*a* of the column cladding 40 is arranged on the lower component 42*b* of the column cladding 40. Moreover, FIG. 1 shows that the upper component 42*a* of the column cladding 40 comprises two side walls 46*a*, 46*b* inclined in the direction of the interior of the operating table column 14. Preferably, these side walls 46*a*, 46*b* of the upper component 42*a* are two side walls which are opposite each other, comprising a front side wall 46*a* in regard to the first direction 30 and a rear side wall 46*b* in regard to the first direction 30.

Moreover, according to FIG. 1 the lower component 42*b* of the column cladding 40 comprises two side walls 48*a*, 48*b* inclined in the direction of the interior of the operating table column 14. Preferably, these side walls 48*a*, 48*b* of the lower component 42*b* are two side walls which are opposite each other, comprising a front side wall 48*a* in regard to the second direction 32 and a rear side wall 48*b* in regard to the second direction 32.

In the sample embodiment shown in FIG. 1, a separation line 50 is shown for the separation of the column cladding 40, running through the upper component 42*a* and the lower component 42*b* of the column cladding 40. Moreover, FIG. 1 shows a half shell-shaped housing element 56 integrated in the lower component 42*b* of the column cladding 40. This half shell-shaped housing element 56 serves to hold an IR receiver for the control of the operating table 10.

Figure 2:
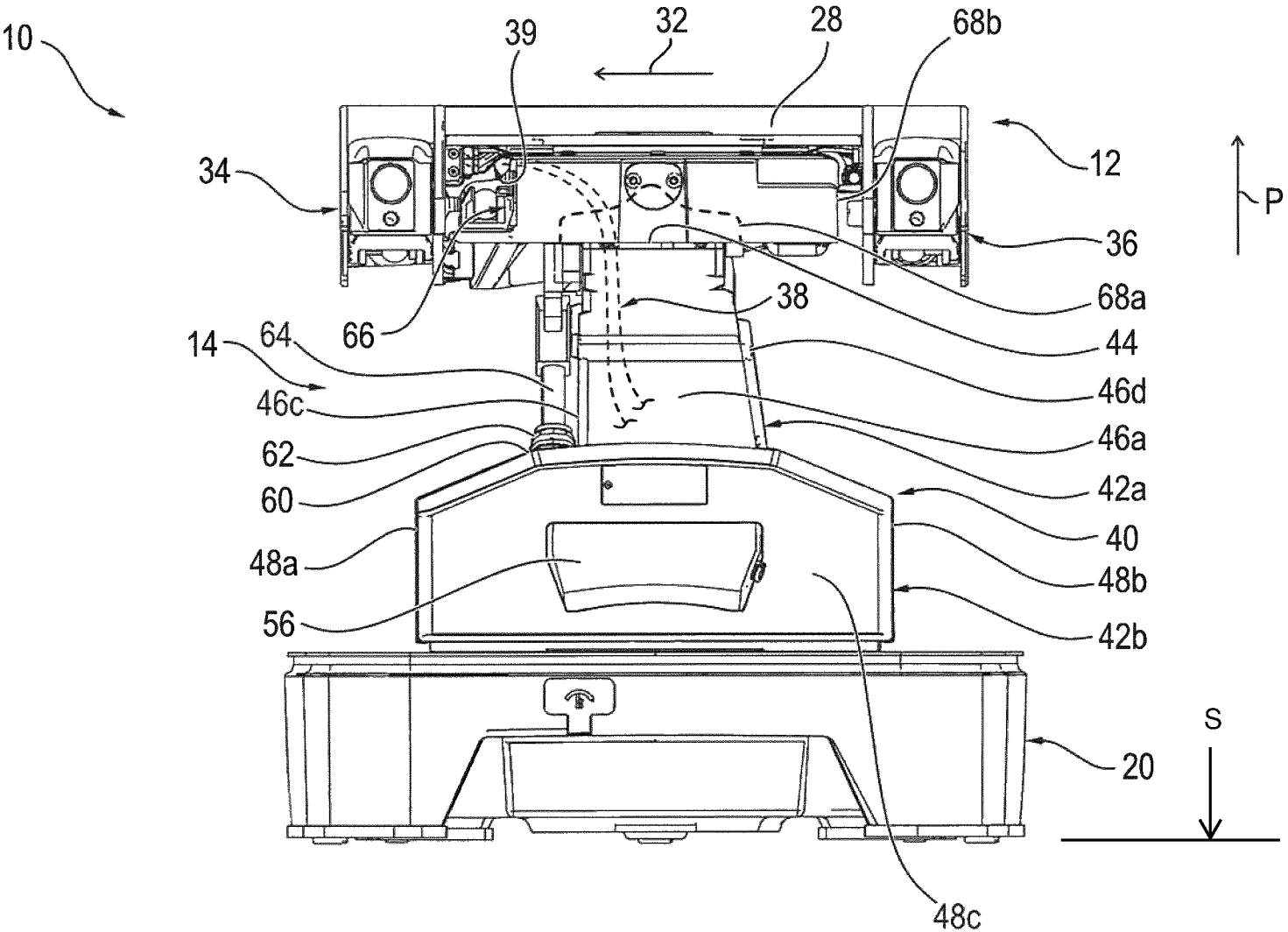
FIG. 2 is a front elevation view of the operating table disclosed in FIG. 1.

FIG. 2 shows a front view of the operating table 10 of FIG. 1. FIG. 2 represents substantially the components 12 to 56 of the operating table 10 shown in FIG. 1. Moreover, FIG. 2 shows a lifting direction P of the patient bearing surface 12. The lifting direction P runs substantially perpendicular to the patient bearing surface 12 situated in its starting position. In FIG. 2, a front side wall 46*c* relative to the second direction 32 and a rear side wall 46*d* relative to the second direction 32 of the column cladding 40 are quite visible. Moreover, in FIG. 2 a front side wall 48*c* relative to the first direction 30 of the lower component 42*b* of the column cladding 40 is quite visible. According to FIG. 2, the half shell-shaped housing element 56 is arranged on this side wall 48*c*.

As is schematically represented in FIG. 2, the sections 39 of the movable parts 38 of the operating table 10 extend through a bellows-free (i.e., lacking a bellows) intermediate space 66. This bellows-free intermediate space 66 extends from an upper edge 44 of the upper component 42*a* of the column cladding 40 as far as the patient bearing surface 12. Preferably, the sections 39 of the movable parts 38 shown in FIG. 2 comprise energy-carrying conduit sections. These conduit sections serve in particular to supply energy to the side rails 34, 36 of the patient bearing surface 12.

FIG. 2 represents by broken line a first headpiece element 68*a* of the operating table column 14. Moreover, in FIG. 2 a second headpiece element 68*b* of the operating table column 14 is quite visible. Preferably, the first and second headpiece elements 68*a*, 68*b* form a universal joint for the gimbal bearing of the patient bearing surface 12. According to FIG. 2, the sections 39 of the movable parts 38 extending through the intermediate space 66 are covered at the side by the first and second headpiece element 68*a*, 68*b* and the first and second side rail 34, 36 of the patient bearing surface 12. Both the first and second headpiece element 68*a*, 68*b* and the first and second side rail 34, 36 constitute rigid components. In this way, a lateral covering of the conduit sections 39 running through the intermediate space 66 can be accomplished merely by the use of rigid components. The use of a bellows is not necessary. Moreover, the lateral covering of the conduit sections 39 extending through the intermediate space 66 can also be accomplished when the first and second side rail 34, 36 or the first and second headpiece element 68*a*, 68*b* are omitted.

According to FIG. 2, the column cladding 40 has an opening 60 provided with a sealing element 62. This opening 60 serves to lead through a tilt cylinder 64 coupled to the patient bearing surface 12. Moreover, the sealing element 62 serves to completely seal off the opening 60 in every position of the tilt cylinder 64. With the help of the tilt cylinder 64, the tilting movement of the patient bearing surface 12 can be realized. As is shown in FIG. 2, the tilt cylinder 64 runs at least partly outside the column cladding 40. The tilt cylinder 64 shown in FIG. 2 is not represented in FIG. 1.

Figure 3:
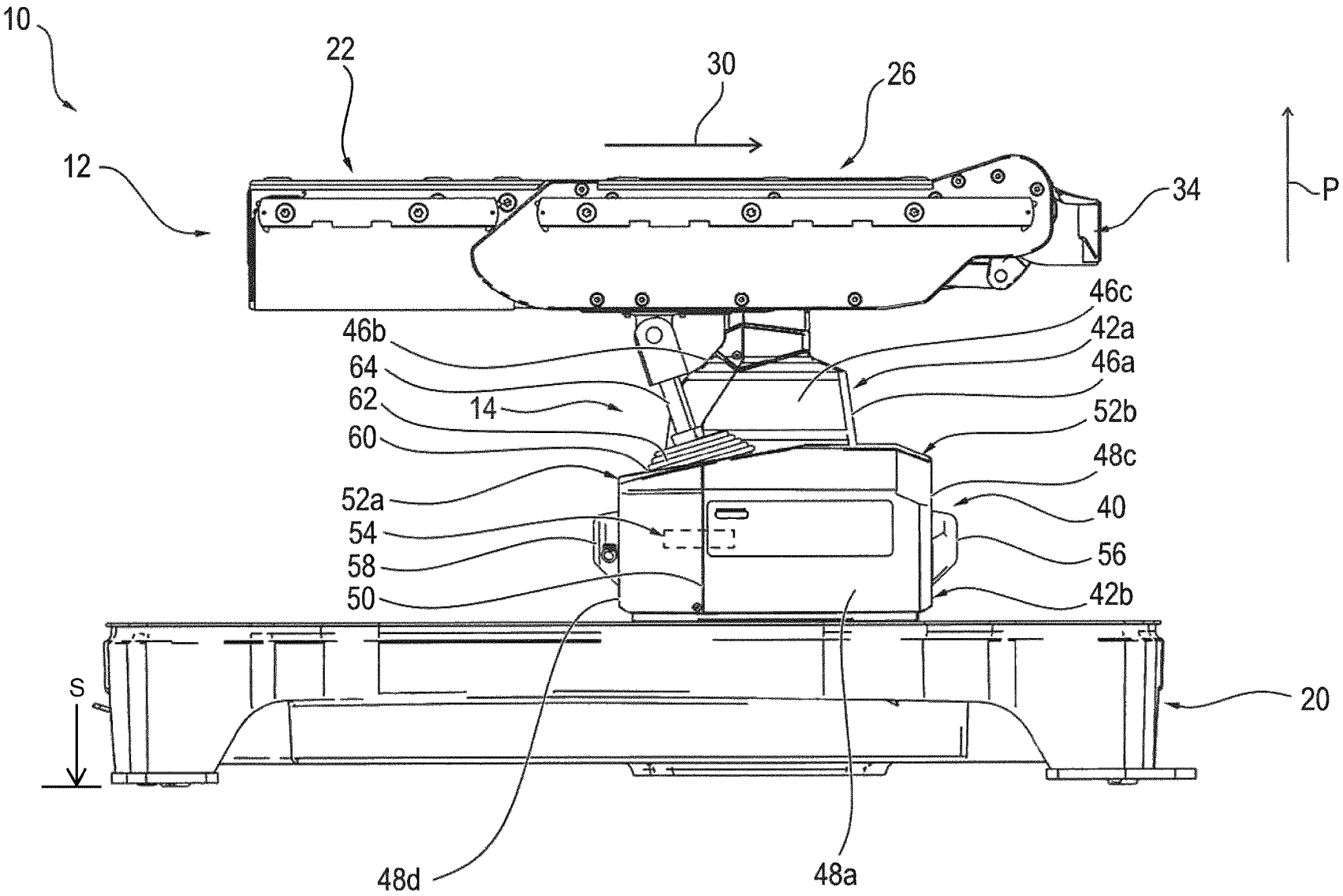
FIG. 3 is a side elevation view of the operating table disclosed in FIG. 1.

FIG. 3 shows a side view of the operating table of FIG. 1. FIG. 3 represents basically the components 12 to 56 and 12 to 64 of the operating table 10 which are shown in FIGS. 1 and 2. Moreover, in FIG. 3 a rear side wall 48*d* of the lower component 42*b* of the column cladding 40 relative to the first direction 30 is quite visible. As shown in FIG. 3, in addition to the half shell-shaped housing element 56 which is arranged on the front side wall 48*c* of the lower component 42*b* relative to the first direction 30, there is arranged another half shell-shaped housing element 58 on the rear side wall 48*d* of the lower component 42*b* relative to the first direction 30. This additional half shell-shaped housing element 58 serves to hold a further IR receiver for the control of the operating table 10.

Moreover, in FIG. 3 the separation line 50 provided in the column cladding 40 is well visible. The separation line 50 shown in FIG. 3 serves to separate the column cladding 40 along this line into two halves 52*a*, 52*b*. The separation line 50 runs substantially in the lifting direction P of the patient bearing surface 12 through the upper component 42*a* and the lower component 42*b* of the column cladding 40. Preferably, the two halves 52*a*, 52*b* of the column cladding 40 can be joined together with the aid of a tongue and groove arrangement 54. In FIG. 3, this tongue and groove arrangement 54 is represented schematically. Preferably, the tongue and groove arrangement 54 is provided in the lower component 42*b* of the column cladding 40. With the aid of this tongue and groove arrangement 54, the two halves 52*a*, 52*b* of the column cladding 40 can be easily and securely joined together.

Figure 4A:
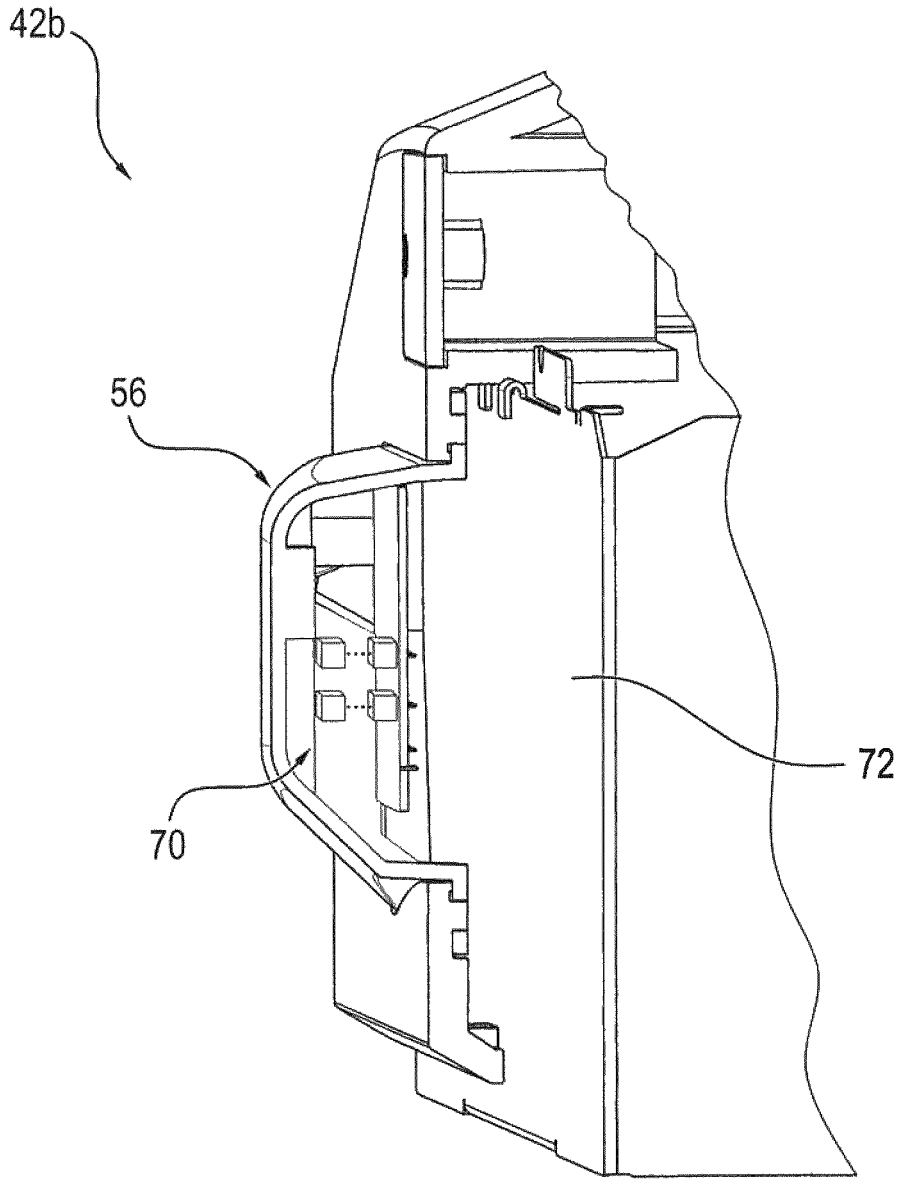
FIG. 4*a* is a perspective view of a half shell-shaped housing element integrated in the column cladding of the operating table of FIG. 1 to hold an IR receiver

FIG. 4*a* shows a perspective view of a half shell-shaped housing element 56 integrated in the column cladding 40 of the operating table 10 of FIG. 1 to hold an IR receiver 70. The housing element 56 with the IR receiver 70 shown in FIG. 4*a* is provided in the lower component 42*b* of the column cladding 40. Preferably, this housing element 56 is fastened without screws to the side wall 48*c* of the lower component 42*b*. This is illustrated with the aid of FIGS. 2 and 4*a*. Moreover, FIG. 4*a* shows an inner column element 72 of the operating table column 14. This inner column element 72 may be comprised of steel such as stainless steel. The IR receiver 70 shown in FIG. 4*a* comprises, for example, several sensors for the detecting/receiving of associated IR signals. With the help of these IR signals detected by the sensors, various functions of the operating table 10 can be controlled during operational use. Moreover, the housing element 56 shown in FIG. 4*a* is passable to IR radiation (i.e., permits the passage of IR radiation).

Figure 4C:
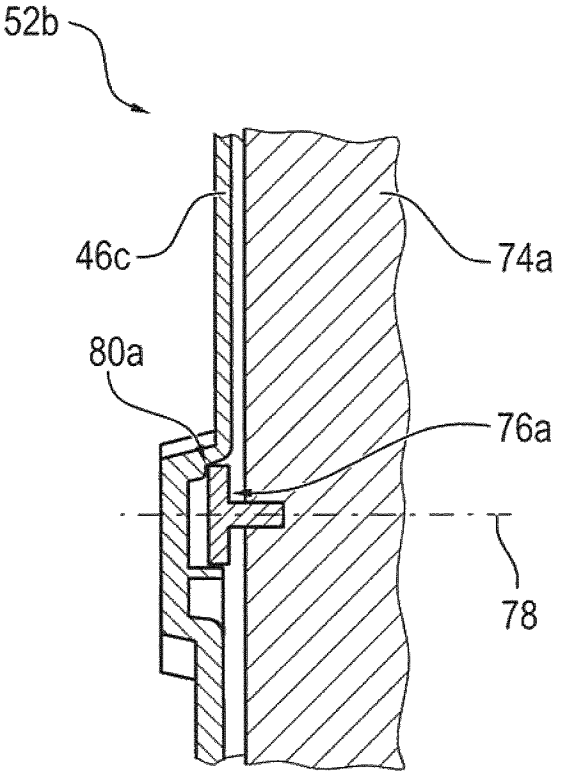
FIG. 4*c* is another schematic cross section representation to illustrate the first journal element shown in FIG. 4*b;*
Figure 4B:
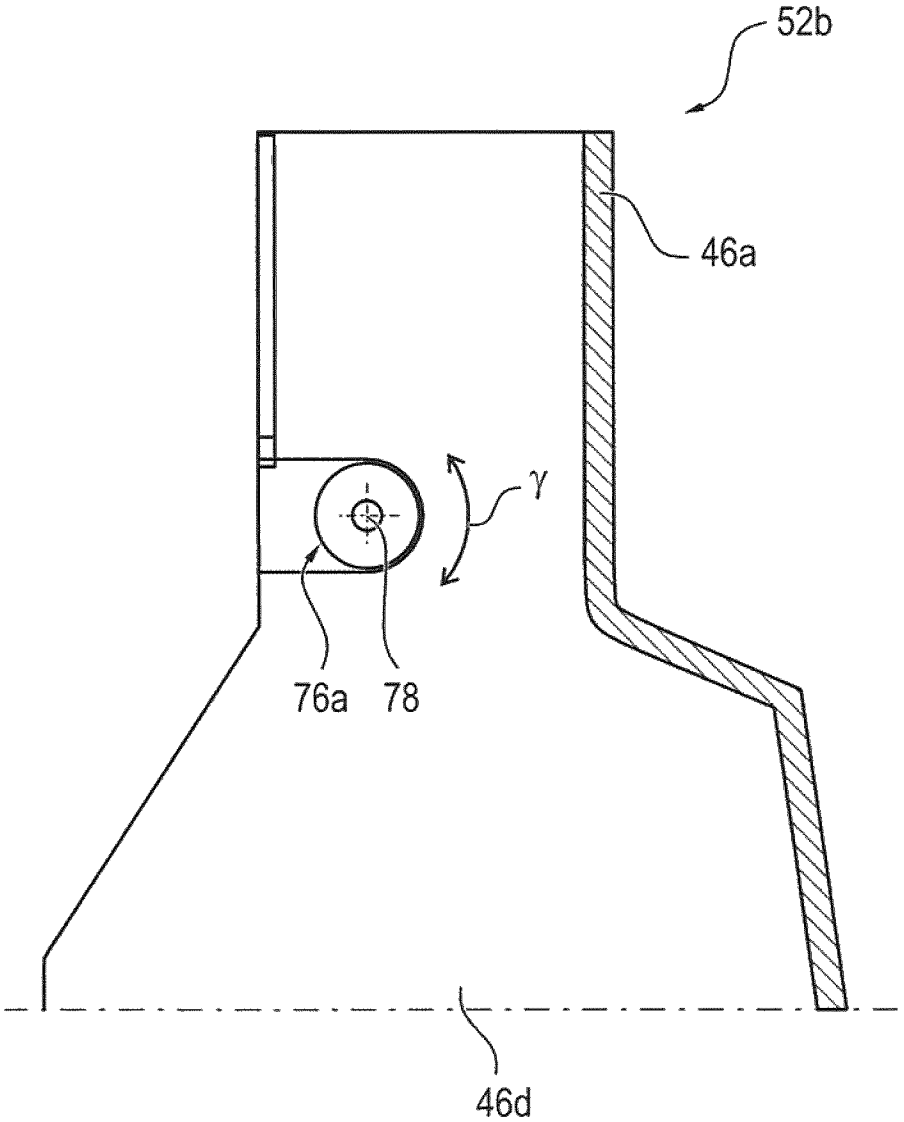
FIG. 4*b* is a schematic cross section representation to illustrate a first journal element arranged on the operating table column of the operating table of FIG. 1 for the rotatable mounting of the column cladding.

FIG. 4*b* shows a schematic cross section representation to illustrate a first journal element 76*a* arranged on the operating table column 14 of the operating table 10 in FIG. 1 for the rotational mounting of the column cladding 40. In particular, FIG. 4*b* shows a schematic cross section representation of the half 52*b* of the column cladding 40 looking in a direction opposite the second direction 32. FIG. 4*c* shows another schematic cross section representation to illustrate the first journal element 76*a* shown in FIG. 4*b*. In particular, FIG. 4*c* shows another schematic cross section representation of the half 52*b* of the column cladding 40 looking in the direction opposite the first direction 30. According to FIGS. 4*b* and 4*c*, the half 52*b* of the column cladding 40 comprises the side walls 46*a* and 46*c*. Moreover, according to FIGS. 4*b* and 4*c*, the first journal element 76*a* is arranged beneath the side wall 46*c*. The first journal element 76*a* shown in FIGS. 4*b* and 4*c* is provided on an inner column element 74*a* of the operating table column 14. In FIG. 4*b* in particular, the inner column element 74*a* is not represented.

Figure 4E:
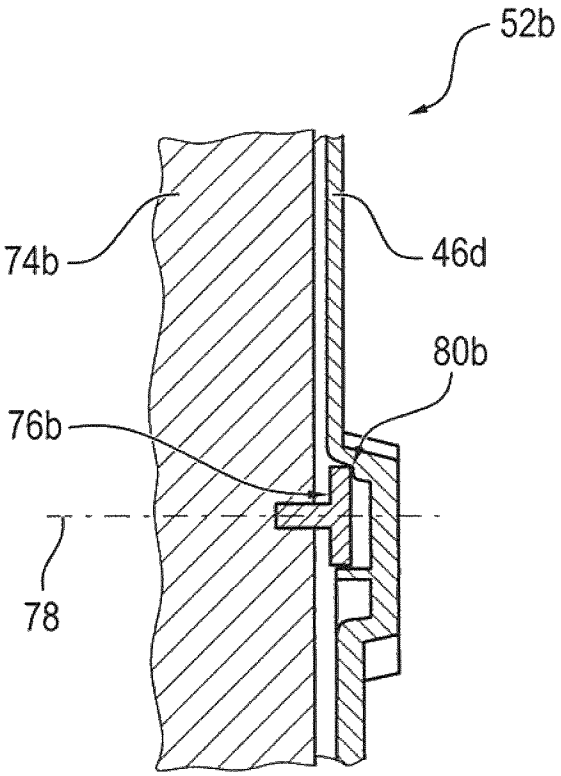
FIG. 4*e* is another schematic cross section representation to illustrate the second journal element shown in FIG. 4*d*.
Figure 4D:
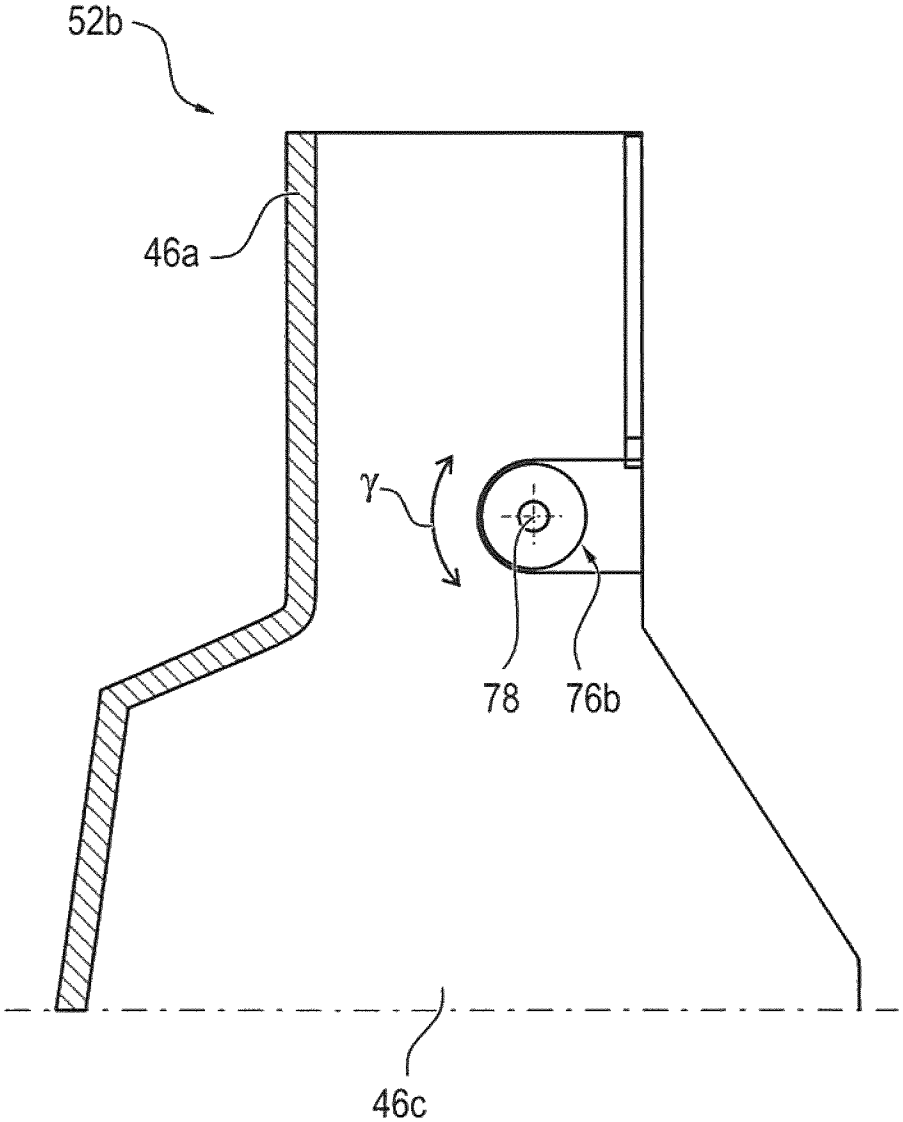
FIG. 4*d* is a schematic cross section representation to illustrate a second journal element arranged on the operating table column of the operating table of FIG. 1 for the rotatable mounting of the column cladding.
Figure 5:
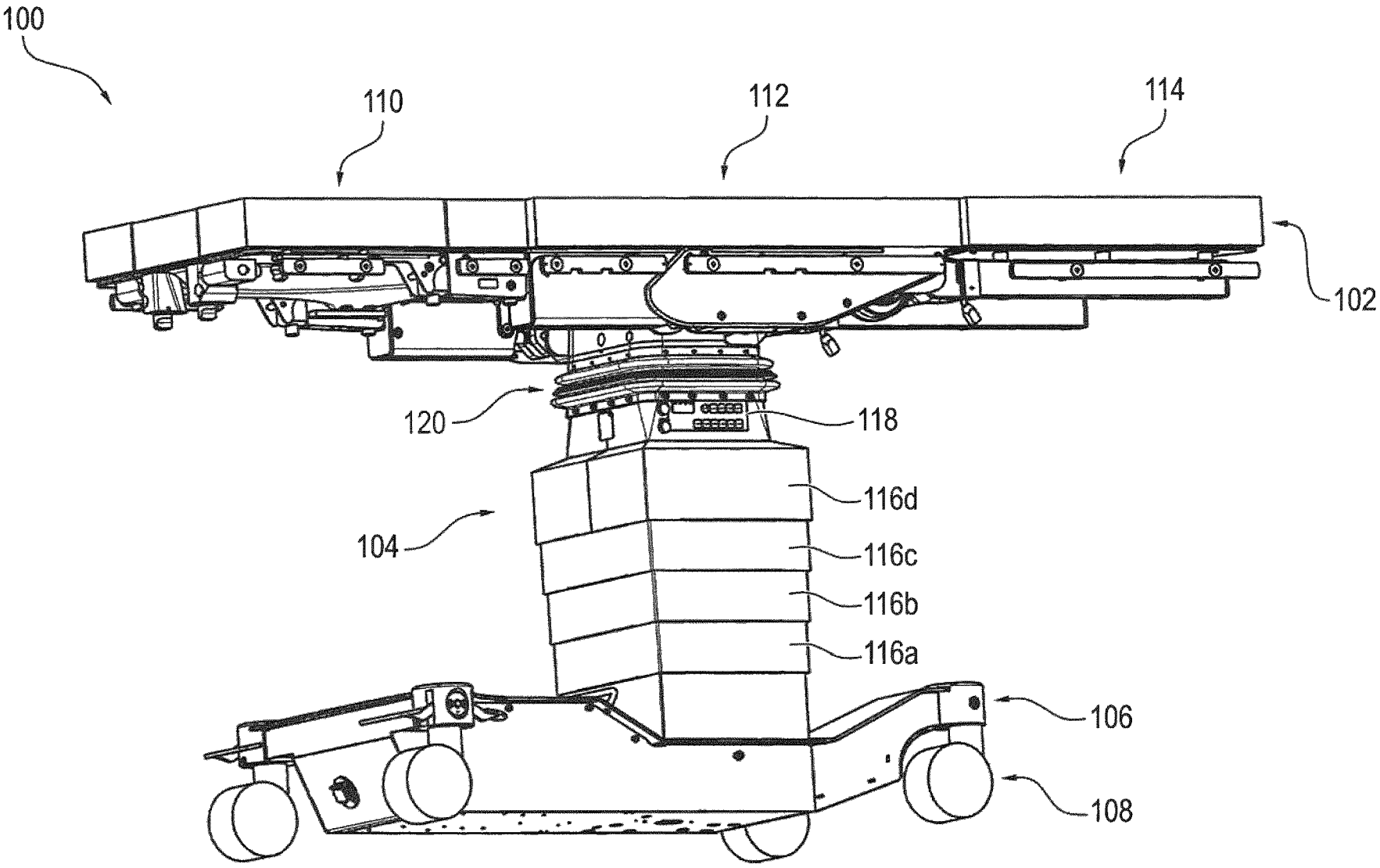
(PRIOR ART) FIG.5
FIGS. 5 and 6 are perspective views of an operating table according to the prior art.
Figure 6:
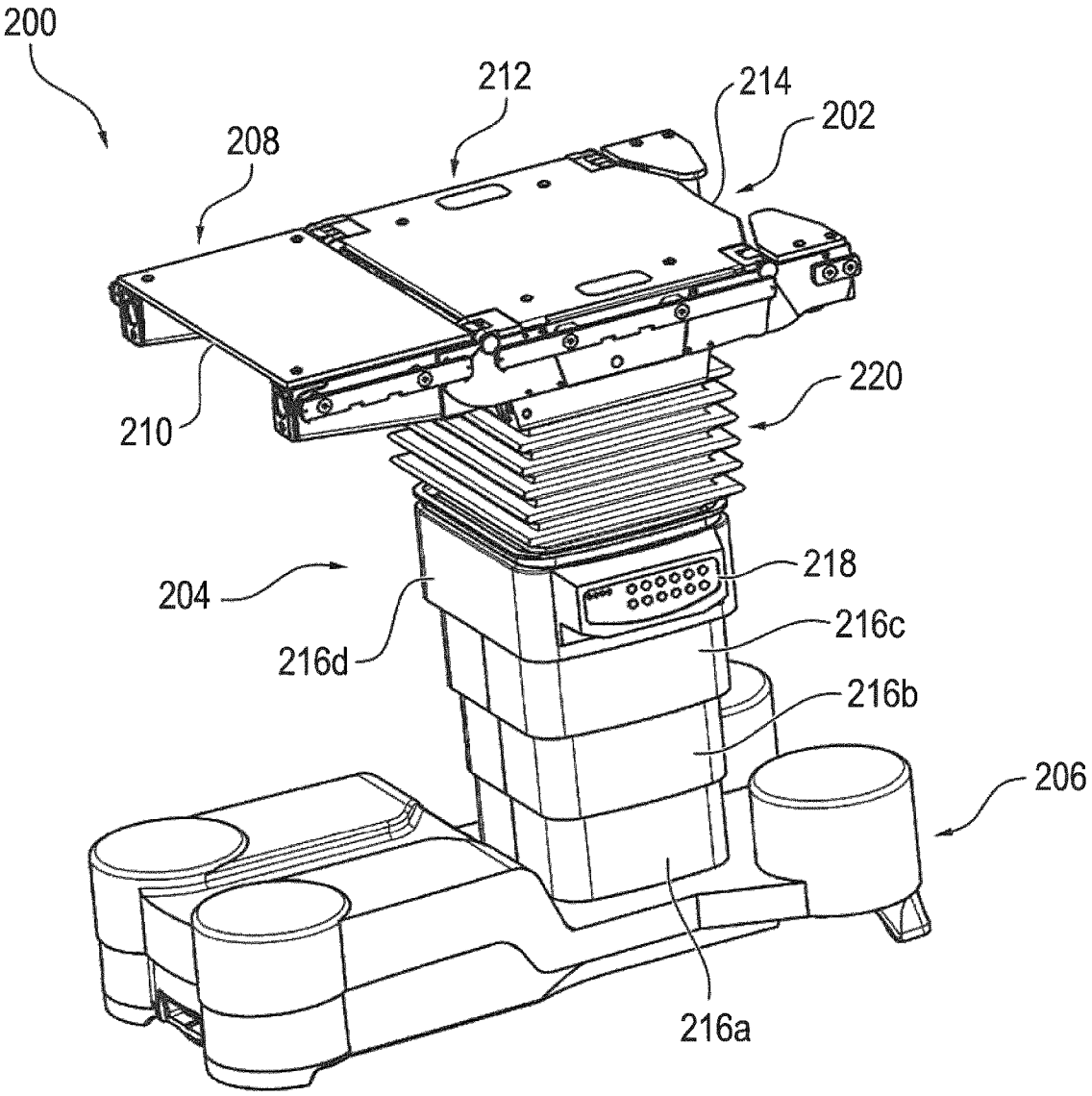
(PRIOR ART) FIG.6

FIG. 4*d* shows a schematic cross section representation to illustrate a second journal element 76*b* arranged on the operating table column 14 of the operating table 10 in FIG. 1 for the rotational mounting of the column cladding 40. In particular, FIG. 4*d* shows a schematic cross section representation of the half 52*b* of the column cladding 40 looking in the second direction 32. FIG. 4*e* shows another schematic cross section representation to illustrate the second journal element 76*b* shown in FIG. 4*d*. In particular, FIG. 4*e* shows another schematic cross section representation of the half 52*b* of the column cladding 40 looking in the direction opposite the first direction 30. According to FIGS. 4*d* and 4*e*, the half 52*b* of the column cladding 40 comprises the side walls 46*a* and 46*d*. Moreover, according to FIGS. 4*d* and 4*e*, the second journal element 76*b* is arranged beneath the side wall 46*d*. The second journal element 76*b* shown in FIGS. 4*d* and 4*e* is provided on an inner column element 74*b* of the operating table column 14. In FIG. 4*d* in particular, the inner column element 74*b* is not represented.

The first and second journal element 76*a*, 76*b* shown in FIGS. 4*b* to 4*e* each serve for the rotatable mounting of the column cladding 40. As is schematically represented in FIGS. 4*b* to 4*e*, in particular the half 52*b* of the column cladding 40 can rotate with the aid of the first and second journal element 76*a*, 76*b* about a common axis of rotation 78 with a third angle of rotation γ. According to FIGS. 4*b* to 4*e*, the axis of rotation 78 runs substantially parallel to the tilt axis 18 shown in FIG. 1 through the center of the first and second journal element 76*a*, 76*b*. Preferably, the third angle of rotation γ is less than or equal to 5°. The third angle of rotation γ is relative to a starting position of the column cladding 40.

According to FIGS. 4*b* to 4*e*, the half 52*b* of the column cladding 40 is shoved onto the first and second journal element 76*a*, 76*b*. Moreover, the half 52*a* of the column cladding 40 shown in FIG. 3 can be firmly connected, for example by a screw, to the half 52*b* of the column cladding 40 shown in FIGS. 4*b* to 4*e*. In this case, the two halves 52*a*, 52*b* of the column cladding 40 form a cohesive unit, which is rotatably mounted on the first and second journal element 76*a*, 76*b*.

Preferably, the first and second journal element 76*a*, 76*b* are arranged symmetrically beneath the two opposite sides 46*c*, 46*d* of the upper component 42*a* of the column cladding 40. That is, the first and second journal element 76*a*, 76*b* are two elements situated opposite each other, through whose centers the common axis of rotation 78 runs.

With the help of FIGS. 4*b* to 4*e*, a rotatable mounting of the column cladding 40 is thus illustrated. Preferably, a first and second cylindrical journal element 76*a*, 76*b* are arranged on the operating table column 14. Indentations 80*a*, 80*b* situated opposite each other are provided on the inside of the side walls 46*c*, 46*d*. The first and second journal element 76*a*, 76*b* engage with these indentations 80*a*, 80*b*. The cohesive unit can be formed by shoving on and connecting the halves 52*a*, 52*b* of the column cladding 40, so that the column cladding 40 can be arranged on the operating table column 14 able to rotate about the axis of rotation 78 running through the first and second journal element 76*a*, 76*b* preferably for angles of rotation up to around 5°. If the patient bearing surface 12 or other elements arranged above the column cladding 40 should collide with the column cladding 40 due to a malfunction, the column cladding 40 can give way thanks to the rotatable mounting. In particular, this prevents the column cladding 40 from being destroyed by an overloading. The user will recognize the malfunction during the movement of the column cladding 40 and can halt the movement.

Embodiments of the present invention have the benefit with respect to the known prior art that no bellows is required. In this way, in particular, there is no need for the cumbersome cleaning of the folds of a bellows during operation use.

The operating table 10 according to the present disclosure is distinguished by good adjustment performance of the patient bearing surface 12. Preferably, a tilting movement of the patient bearing surface 12 can be performed with an angle of inclination greater than 20° and a lateral tilting of the patient bearing surface 12 with a tilting angle greater than 15°. In the operating table 10 according to the present disclosure, drive units and load-bearing components are protected by the column cladding 40. This prevents liquids from getting into the drive units and control systems, or users from getting caught by the moving drive units. Moreover, with the help of the column cladding 40, shearing and pinching places can be covered. Unlike the known prior art, the intermediate space 66 containing the sections 39 of the moving parts 38 is not covered laterally by a bellows.

According to embodiments of the present disclosure, the patient bearing surface 12 is arranged on the operating table column 14. Moreover, the drive rod of the tilt cylinder 64 is coupled to the patient bearing surface 12 such that an opening 60 with a sealing element 62 can be arranged in the column cladding 40. With the aid of this opening 60, it is possible to replace damaged components of the column cladding 40 without dismantling the drive rod of the tilt cylinder 64. The half 52*a* of the column cladding 40 is pulled off to the left, for example, in FIG. 3. Moreover, the half 52*b* of the column cladding 40 can be pulled off to the right in FIG. 3. The tongue and groove arrangement 54 represented in FIG. 3 is provided at the separation line 50 between the half 52*a* and the half 52*b*.

Preferably, the halves 52*a*, 52*b* of the column cladding 40 are mounted floating on fixed elements. In event of an unintentional collision of the patient bearing surface 12 with the halves 52*a*, 52*b* of the column cladding 40, these can give way by up to 15 mm, so that a damage of the column cladding 40 or the colliding components of the patient bearing surface 12 can be avoided. This collision occurs in particular due to lack of attention. The user can also be made aware of the error by an elastic deformation of the column cladding 40. Therefore the user will then have enough time to halt the moving function before permanent damage results.

In at least one of the two halves 52*a*, 52*b* of the column cladding 40 there is embedded the infrared-passable housing element 58 or 56. With the aid of this housing element 58, 56, data communication via infrared communication to and from a remote controller to the operating table is easily possible. Due to the easy dismantling by pulling off the two halves 52*a*, 52*b* of the column cladding 40 to the left and right in FIG. 3, a technician can easily maintain the elements lying underneath. By contrast with the known prior art, no outside situated screws need to be loosened in order to remove the half shell-shaped, infrared-passable housing element 56 or 58. In particular, no complicated removable seals are required. Moreover, the cleaning is not disturbed by screws. In the operating table 10 according to the present disclosure, the housing element 58 is firmly incorporated into the half 52*a* of the column cladding 40, while the housing element 56 is firmly incorporated into the half 52*b* of the column cladding 40. The housing element 56, 58 should be arranged on the side wall 48*c* or 48*d*. It should not be arranged on the side wall 48*a* containing an operating panel, because this would disturb a user standing alongside it.

According to sample embodiments, the components 42*a*, 42*b* of the column cladding 40 are made from low-cost plastic. In this way, the expensive welded assemblies of refined steel as known in the prior art can be dispensed with. Thanks to the arrangement of the dome-shaped upper component 42*a* of the column cladding 40 between the side rails 34, 36 of the patient bearing surface 12, the bellows of the prior art can be avoided. The roofing effect of the patient bearing surface 12 prevents a penetration of liquids, which usually drip down from above, i.e., from the patient bearing surface 12. The dome-shaped upper component 42*a* desirably is firmly joined to the lower component 42*b* of the column cladding 40. A separation line 50 runs both through the upper component 42*a* and the lower component 42*b*. With the aid of the column cladding 40, all movable machine parts can be arranged protected inside the operating table 10 so that the user is not injured. Also with the aid of a suitable rounding or beveling of the column cladding 40 made of plastic, the cleaning of the operating table 10 can be facilitated and the movement range of the patient bearing surface 12 increased.

The foregoing description of the embodiments of the present disclosure has been presented for the purpose of illustration and description only and is not to be construed as limiting the scope of the invention in any way. It is intended that the specification and the disclosed examples be considered as exemplary only, with a true scope being indicated by the following claims.

We claim:

1. An operating table comprising:

an operating table column comprising a column cladding with at least an upper rigid component arranged above a lower rigid component; and a patient bearing surface arranged on the operating table column, wherein the operating table column is designed so that all movable parts of the operating table running inside the operating table column are completely covered laterally, wherein an intermediate space extends from an upper edge of the upper rigid component of the column cladding to the patient bearing surface, the intermediate space lacking a bellows, and wherein the column cladding has two halves which can be joined together to form in a joined state the upper rigid component and the lower rigid component of the column cladding.

2. The operating table as claimed in claim 1, wherein sections of the movable parts which extend from the upper edge of the upper rigid component of the column cladding to the patient bearing surface are covered laterally, at least in part, by a first and second rigid headpiece element of the operating table column.

3. The operating table as claimed in claim 1, wherein sections of the movable parts which extend from the upper edge of the upper rigid component of the column cladding to the patient bearing surface are covered laterally, at least in part, by a first and second rigid side rail of the patient bearing surface.

4. The operating table as claimed in claim 1, wherein sections of the movable parts which extend from the upper edge of the upper rigid component of the column cladding to the patient bearing surface are covered laterally, at least in part, by a first and second rigid headpiece element of the operating table column and a first and second rigid side rail of the patient bearing surface.

5. The operating table as claimed in claim 1, wherein the upper rigid component of the column cladding comprises at least two side walls which are inclined at least partly in a direction of an interior of the operating table column.

6. The operating table as claimed in claim 5, wherein the side walls of the upper rigid component which are inclined in the direction of the interior of the operating table column are two side walls which are situated opposite each other, wherein the two opposite side walls of the upper rigid component comprise a front side wall relative to a first direction parallel to a longitudinal direction of the patient bearing surface and a rear side wall relative to a first direction parallel to the longitudinal direction of the patient bearing surface.

7. The operating table as claimed in claim 1, wherein the lower rigid component of the column cladding comprises at least two side walls which are inclined at least partly in a direction of an interior of the operating table column.

8. The operating table as claimed in claim 7, wherein the side walls of the lower rigid component which are inclined in the direction of the interior of the operating table column are two side walls which are situated opposite each other, wherein the two opposite side walls of the lower rigid component comprise a front side wall relative to a second direction parallel to a transverse direction of the patient bearing surface and a rear side wall relative to the second direction parallel to the transverse direction of the patient bearing surface.

9. The operating table as claimed in claim 1, wherein the column cladding comprises at least one half shell-shaped housing element integrated in a side wall of the lower rigid component of the column cladding in order to hold an IR receiver, wherein the half shell-shaped housing element is secured without screws to a side wall of the lower component.

10. The operating table as claimed in claim 1, wherein the column cladding comprises a tongue and groove arrangement for joining the two halves of the column cladding.

11. The operating table as claimed in claim 1, wherein the column cladding has an opening for leading through it a tilt cylinder coupled to the patient bearing surface, wherein the opening is provided with a sealing element, and the sealing element is configured such that the opening is completely sealed in each position of the tilt cylinder.

12. The operating table as claimed in claim 1, wherein the patient bearing surface is rotatable about a tilt axis by a first angle of rotation ($\alpha$) greater than 20° in a positive and negative direction of rotation and/or about a lateral tilt axis by a second angle of rotation ($\beta$) greater than 15° in the positive and negative direction of rotation, the first angle of rotation ($\alpha$) and the second angle of rotation ($\beta$) being relative to a starting position of the patient bearing surface.

13. The operating table as claimed in claim 1, wherein the upper rigid component and the lower rigid component of the column cladding are made of plastic.

14. The operating table as claimed in claim 1, wherein the movable parts comprise one or more hydraulic lines capable of conveying hydraulic energy through at least a portion of the operating table column towards the patient bearing surface.

15. The operating table as claimed in claim 1, wherein the movable parts comprise one or more electrical lines capable of conveying electrical energy through at least a portion of the operating table column towards the patient bearing surface.

16. The operating table as claimed in claim 1, wherein the movable parts comprise both one or more hydraulic lines capable of conveying hydraulic energy through at least a portion of the operating table column towards the patient bearing surface, and one or more electrical lines capable of conveying electrical energy through at least a portion of the operating table column towards the patient bearing surface.

17. An operating table comprising:

an operating table column comprising a column cladding with at least an upper rigid component arranged above a lower rigid component; and a patient bearing surface arranged on the operating table column, wherein the operating table column is designed so that all movable parts of the operating table running inside the operating table column are completely covered laterally, wherein an intermediate space extends from an upper edge of the upper rigid component of the column cladding to the patient bearing surface, the intermediate space lacking a bellows, and wherein the column cladding comprises at least one half shell-shaped housing element integrated in a side wall of the lower rigid component of the column cladding in order to hold an IR receiver, wherein the half shell-shaped housing element is secured without screws to a side wall of the lower component.

18. The operating table as claimed in claim 17, wherein sections of the movable parts which extend from the upper edge of the upper rigid component of the column cladding to the patient bearing surface are covered laterally, at least in part, by a first and second rigid headpiece element of the operating table column.

19. The operating table as claimed in claim 17, wherein sections of the movable parts which extend from the upper edge of the upper rigid component of the column cladding to the patient bearing surface are covered laterally, at least in part, by a first and second rigid side rail of the patient bearing surface.

20. The operating table as claimed in claim 17, wherein sections of the movable parts which extend from the upper edge of the upper rigid component of the column cladding to the patient bearing surface are covered laterally, at least in part, by a first and second rigid headpiece element of the operating table column and a first and second rigid side rail of the patient bearing surface.

21. The operating table as claimed in claim 17, wherein the upper rigid component of the column cladding comprises at least two side walls which are inclined at least partly in a direction of an interior of the operating table column.

22. The operating table as claimed in claim 21, wherein the side walls of the upper rigid component which are inclined in the direction of the interior of the operating table column are two side walls which are situated opposite each other, wherein the two opposite side walls of the upper rigid component comprise a front side wall relative to a first direction parallel to a longitudinal direction of the patient bearing surface and a rear side wall relative to a first direction parallel to the longitudinal direction of the patient bearing surface.

23. An operating table comprising:

an operating table column comprising a column cladding with at least an upper rigid component arranged above a lower rigid component; and a patient bearing surface arranged on the operating table column, wherein the operating table column is designed so that all movable parts of the operating table running inside the operating table column are completely covered laterally, wherein an intermediate space extends from an upper edge of the upper rigid component of the column cladding to the patient bearing surface, the intermediate space lacking a bellows, and wherein the upper rigid component of the column cladding comprises at least two side walls which are inclined at least partly in a direction of an interior of the operating table column.

* * * * *